US009289783B2

(12) United States Patent
Wang

(10) Patent No.: US 9,289,783 B2
(45) Date of Patent: Mar. 22, 2016

(54) NOZZLE ADJUSTMENT MEMBER FOR SPRINKLER

(75) Inventor: King-Yuan Wang, Taichung (TW)

(73) Assignee: YUAN-MEI CORP., Taichung (TW)

( * ) Notice: Subject to any disclaimer, the term of this patent is extended or adjusted under 35 U.S.C. 154(b) by 901 days.

(21) Appl. No.: 12/662,295

(22) Filed: Apr. 9, 2010

(65) Prior Publication Data

US 2011/0248102 A1 Oct. 13, 2011

(51) Int. Cl.

| | |
|---|---|
| ***B05B 3/16*** | (2006.01) |
| ***B05B 1/14*** | (2006.01) |
| ***B05B 15/06*** | (2006.01) |
| ***B05B 15/08*** | (2006.01) |

(52) U.S. Cl.

CPC ..... *B05B 1/14* (2013.01); *B05B 15/066* (2013.01); *B05B 15/08* (2013.01)

(58) Field of Classification Search

CPC ..... B05B 15/04; B05B 15/08; B05B 15/066; B05B 1/14

USPC ..... 239/225.2, 227, 242, 240, 246, 247, 239/DIG. 1, DIG. 12

See application file for complete search history.

(56) References Cited

U.S. PATENT DOCUMENTS

D282,769 S * 2/1986 Lemkin et al. ..... D23/216

* cited by examiner

*Primary Examiner* — Arthur O Hall
*Assistant Examiner* — Viet Le
(74) *Attorney, Agent, or Firm* — Raymond Y. Chan; David and Raymond Patent Firm

(57) ABSTRACT

A nozzle adjustment member for a sprinkler is revealed. A plurality of nozzle tubes aligned in at least one row is positioned on a wall of a hollow pipe. A top end of the nozzle tube is projecting to an outside of the hollow pipe. At least one pivot support is disposed on the outside of the hollow pipe. Each pivot support is pivoted with an adjustment piece having a plurality of guiding openings. The guiding openings are positioned over the plurality of nozzle tubes correspondingly. A nozzle cover is connected with the outside of the hollow pipe for covering the adjustment piece. A plurality of long through holes for mounting the corresponding nozzle tubes is arranged at the nozzle cover. Around a pivot hole, the adjustment piece swings so as to drive the plurality of nozzle tubes moving at an angle and different water distribution patterns are provided.

22 Claims, 17 Drawing Sheets

NOZZLE ADJUSTMENT MEMBER FOR SPRINKLER

BACKGROUND OF THE INVENTION

1. Fields of the Invention

The present invention relates to a sprinkler, especially to a nozzle adjustment member for a sprinkler that adjusts water distribution patterns from a plurality of parallel water jets into water jets with different angles therebetween by increasing of the angle between two adjacent water flows gradually.

2. Descriptions of Related Art

Refer to prior arts such as EP 0970752 A2, U.S. Pat. No. 6,135,356, DE 19830861, and US 20080054103 A1, the adjustment apparatus in these patents adjusts nozzles mounted therein synchronously by a parallel displacement of the nozzle or displacement on two-sides in different directions. Thus the nozzles move at an angle synchronously so as to provide sprinkling patterns with different angles. However, the adjustment apparatus is not located by a fixed pivot and the operation is not smooth.

Thus there is a need to improve the nozzle adjustment apparatus for sprinklers available now so as to provide a novel design of the nozzle adjustment apparatus for sprinklers.

SUMMARY OF THE INVENTION

Therefore it is a primary object of the present invention to provide a nozzle adjustment member for a sprinkler that includes at least one pivot support arranged on outside of a hollow pipe and the pivot support is pivoted with an adjustment piece having a plurality of guiding openings. Each guiding opening is positioned over a corresponding nozzle tube projecting from the hollow pipe. Thereby the adjustment piece swings around the pivot support (as a pivot) so as to drive the plurality of nozzles moving and tilting at different angles for providing various sprinkling patterns.

In order to achieve the above object, a nozzle adjustment member for a sprinkler according to the present invention mainly includes a hollow pipe, at least one adjustment piece and a nozzle cover.

The hollow pipe is connected with a pivot disposed on a top of a seat of a sprinkler. A flat top stage with a plurality of holes is arranged on top of the hollow pipe. The plurality of holes is arranged into at least one row and each hole is positioned over a corresponding nozzle tube. A top end of each nozzle tube projects from the hole and a bottom of each nozzle tube is connected in series by at least one belt. Moreover, at least one pivot support is arranged at outside of the flat top stage and is pivoted with the adjustment piece for swinging and movement of the adjustment piece.

The adjustment piece includes a pivot hole pivoted with the above pivot support arranged at one end thereof, a plurality of guiding openings spaced at an interval on the other end thereof and at least one control part on the end opposite to the end with the pivot hole. The plurality of guiding openings is positioned over the plurality of nozzle tubes. The control part is for convenience of holding and moving the adjustment piece and is integrated with the adjustment piece.

The nozzle cover is fastened and connected with an outside of the hollow pipe for covering the adjustment piece. A plurality of long through holes for being assembled with corresponding nozzle tubes is disposed on top of the nozzle cover.

In accordance with the structure form by above components, the pivot hole and the pivot support pivoted with each other is used as a rotation pivot and the adjustment piece can swing and move for synchronously driving the nozzle tube positioned inside each guiding opening to move at different angles. Due to the change of the angle of the nozzle tube driven by the corresponding guiding opening of the adjustment piece, the water distribution pattern changes from a plurality of parallel water jets into water jets with increasing angles therebetween and more sprinkling patterns are provided.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
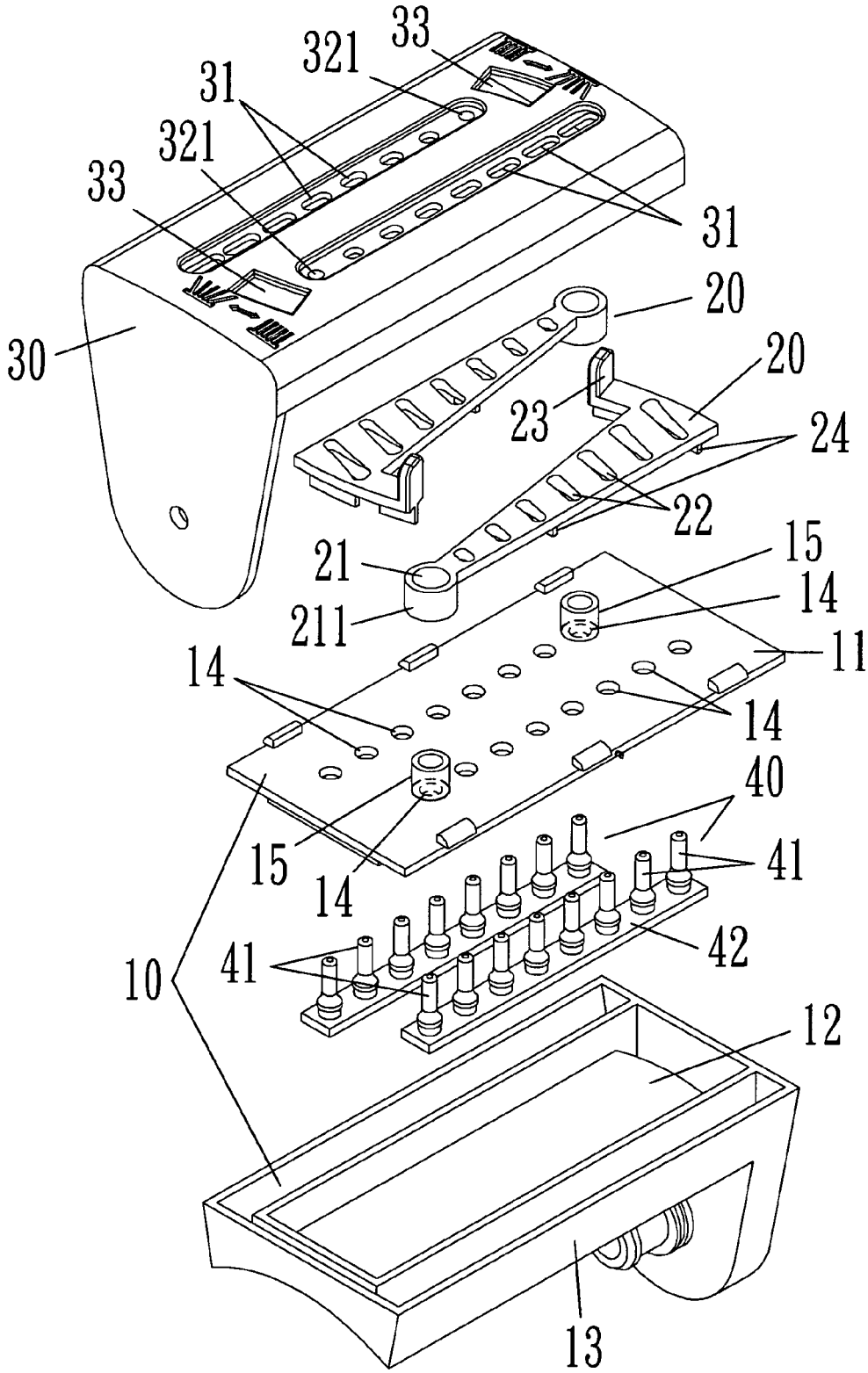
FIG. 1 is an explosive view of an embodiment according to the present invention.
Figure 2:
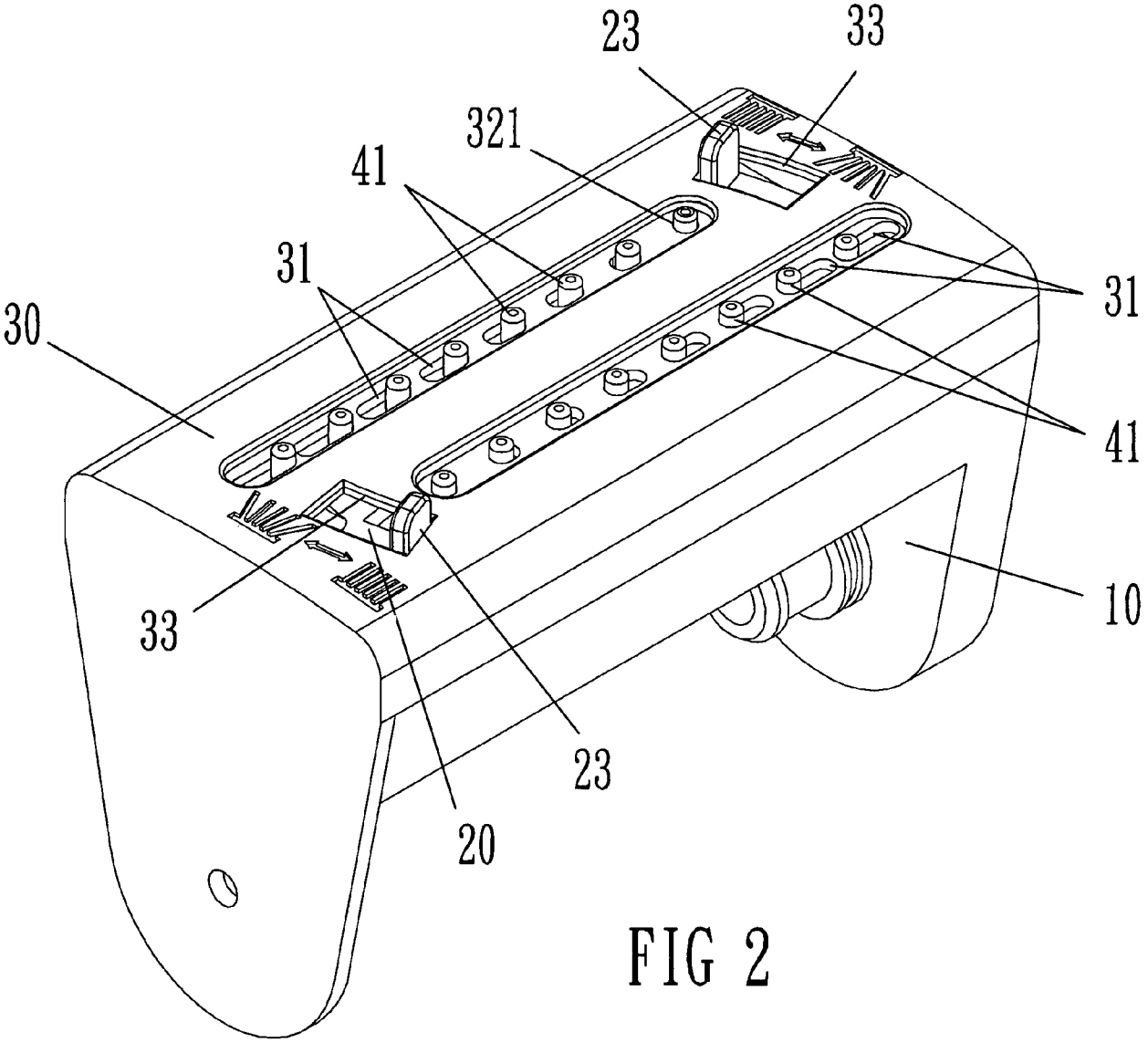
FIG. 2 is a perspective view of an embodiment according to the present invention.
Figure 3:
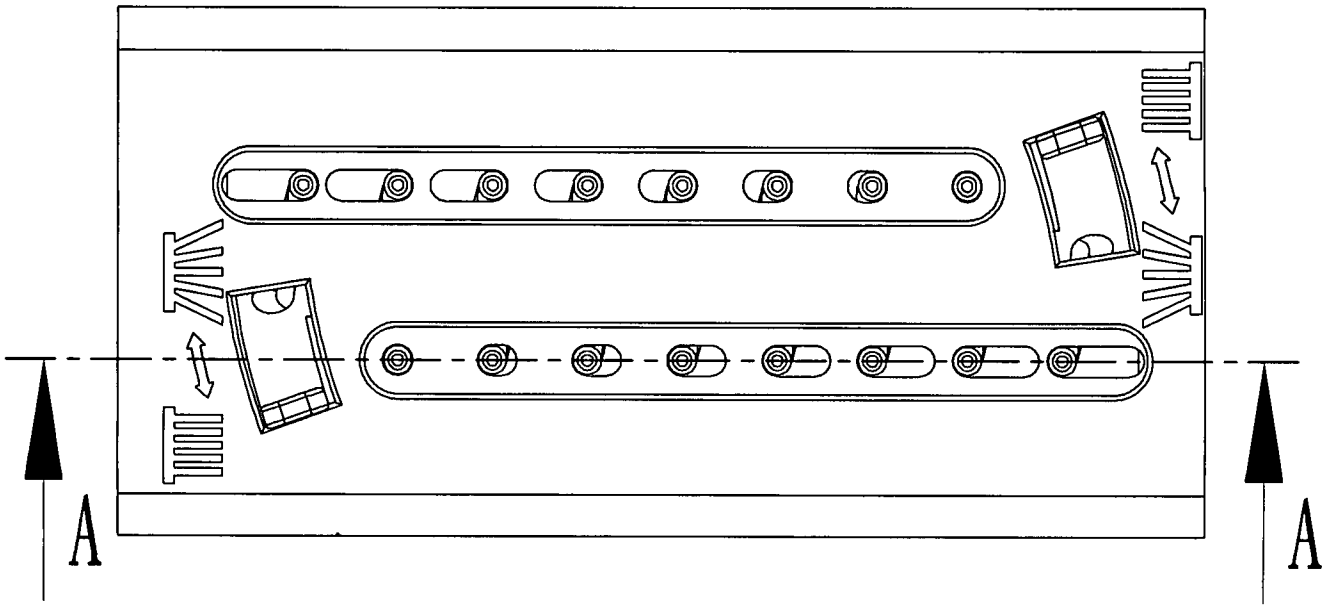
FIG. 3 is a top view of an embodiment according to the present invention.
Figure 4:
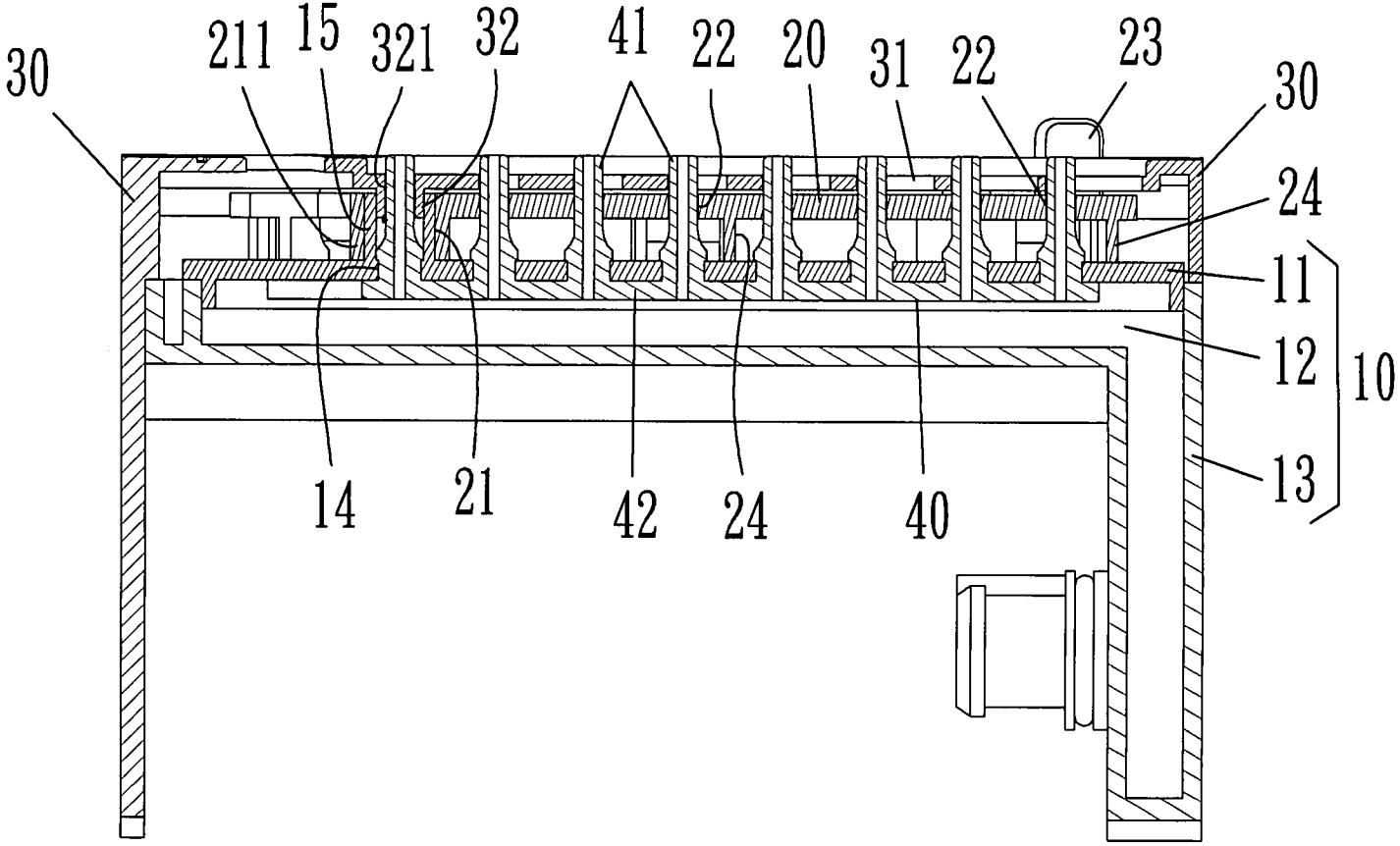
FIG. 4 is a cross sectional view along the A-A line of the embodiment in FIG. 3.

Refer from FIG. 1 to FIG. 4, a nozzle adjustment member for a sprinkler according to the present invention includes a hollow pipe 10, two adjustment pieces 20, a nozzle cover 30 and two nozzle sets 40.

The hollow pipe 10 consists of a flat top stage 11 and a base 13 with a receiving slot 12 whose opening is facing upward. A plurality of holes 14 spaced at an interval is disposed on a top wall of the hollow pipe 10. There is at least one row of aligned holes 14. In this embodiment, the aligned holes 14 are arranged into two rows. Two pivot supports 15 with the same height extending upward are arranged at two diagonal corners of the two rows of aligned holes 14. The holes 14 are positioned over and assembled with a plurality of nozzle tubes 41 of two nozzle sets 40 inside the hollow pipe 10. The hole 14 inside the pivot support 15 is assembled with corresponding nozzle tube 41 of the nozzle set 40 while the pivot support 15 itself is received in a pivot hole 21 at one end of the adjustment piece 20.

Each of the two nozzle sets 40 consists of a plurality of nozzle tubes 41 and a belt 42 connecting the bottom of the plurality of nozzle tubes 41. And the plurality of nozzle tubes 41 of each nozzle set 40 is assembled with and located in two rows of holes 14 on the hollow pipe 10. Moreover, the belt 42 of each nozzle set 40 can be integrated into one piece.

The adjustment piece 20 includes a pivot hole 21 disposed on one end and a plurality of guiding openings 22, extending outward from the pivot hole 21 to the outer end thereof. A pivot bushing 211 extending downward is disposed on the bottom of one end of the adjustment piece 20, around the pivot hole 21. The pivot bushing 211 is for being pivoted in or covered around the pivot support 15 of the hollow pipe 10. Moreover, at least one pin 24 is set on the bottom of the other end of the adjustment piece 20. The pivot bushing 211 and the pin 24 are at the same height and their bottom is leaning against the flat top stage 11 of the hollow pipe 10. Furthermore, a sheet-like control part 23 is arranged on one end of the adjustment piece 20, opposite to the end with the pivot hole 21.

The nozzle cover 30 is a cover with a downward opening for connecting with and covering the hollow pipe 10. A plurality of long through holes 31 is disposed on top of the nozzle cover 30 and is arranged into two rows. The long through holes 31 of each row are integrated to form a slot or a plurality of grooves longer than the long through hole (not shown in figure). Each row of the long through holes 31 is positioned over the plurality of nozzle tubes 41 of one nozzle set 40 correspondingly. At least one shaft tube 32 is arranged at one end of each row of the plurality of through holes 31 so as to insert into the pivot support 15 of the hollow pipe 10 or the pivot hole 21 of the adjustment piece 20. Moreover, a receiving space 33 is disposed on each of two diagonal corners. The receiving space 33 is not only for receiving the control part 23, but also providing a certain space for displacement of the control part 23. Each row of long through holes 31 can also be divided into a plurality of long grooves. In this embodiment, the shaft tube 32 is mounted in the pivot support 15 and is having a preset shaft hole 321 that is positioned over the corresponding nozzle tube 41.

Thereby, the nozzle adjustment member for a sprinkler according to the present invention includes at least two rows of nozzle tubes 41 for adjusting parallel water jets. The two adjustment pieces 20 swing respectively around the pivot hole 21 that is used as a static pivot so as to move the plurality of nozzle tubes 41 at different angle synchronously.

In addition, the nozzle tube 41 mounted in the corresponding hole 14 of the pivot support 15 of the hollow pipe 10 can be removed and this has no effect on the movement and displacement of the adjustment piece.

Figure 5:
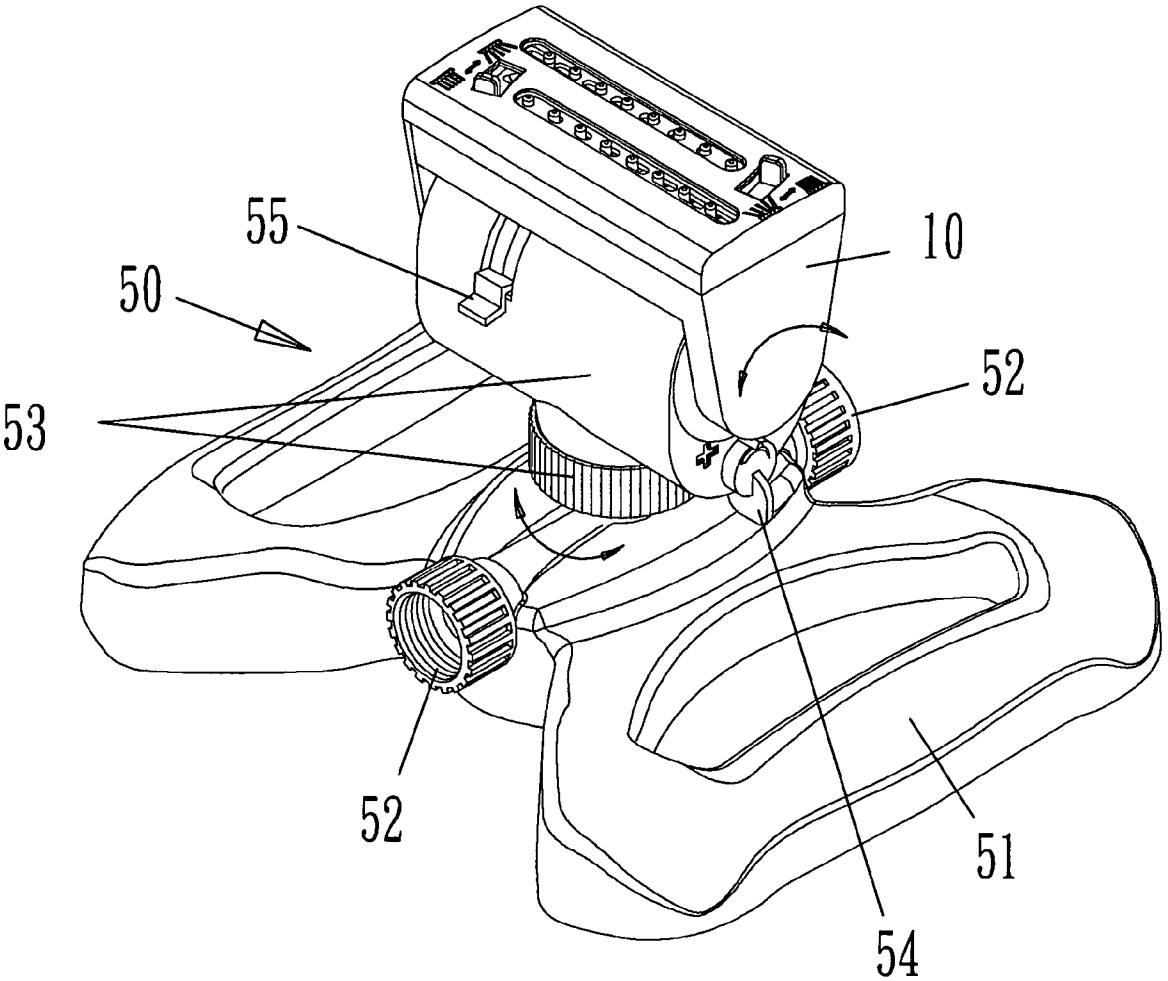
FIG. 5 is a schematic drawing showing an embodiment of the present invention connected with a sprinkler.
Figure 6:
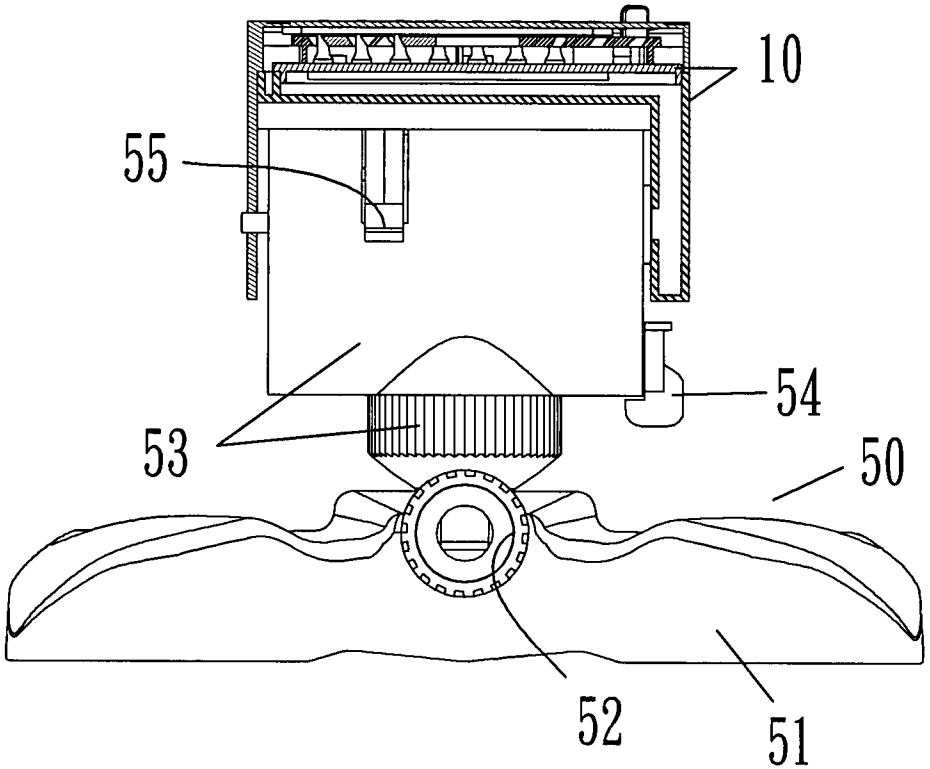
FIG. 6 is a front view of the embodiment connected with the sprinkler in FIG. 5.
Figure 7:
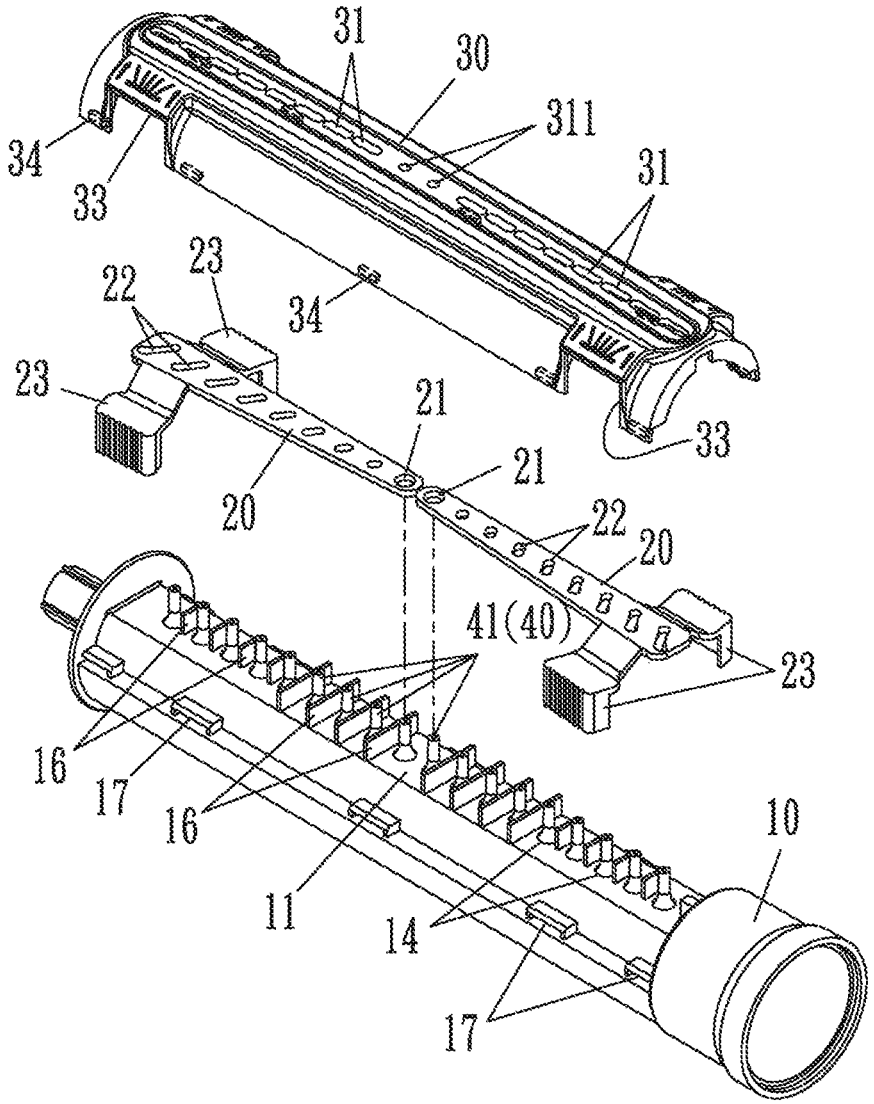
FIG. 7 is an explosive view of another embodiment according to the present invention.

Refer to FIG. 5 and FIG. 6, the nozzle adjustment member of the present invention is connected with a sprinkler in use. The sprinkler 50 in this embodiment includes a seat 51 and at least one water inlet 52 arranged at least one side of the seat 51 for connected with a water source, a pivot 53 that rotates 360 degrees, clockwise or counterclockwise, and a fine adjustment knob 54 for control of outlet water flow extending outward from the pivot 53. The two sides of the pivot 53 are connected with the hollow pipe 10 of the nozzle adjustment member of the present invention. Moreover, a control button 55 for adjustment angle of the forward and backward movement of the hollow pipe 10 is disposed on a preset position of the pivot 53. Thus the sprinkler is formed completely.

Refer from FIG. 7 to FIG. 15, another embodiment of a nozzle adjustment member for a sprinkler with the same effects is revealed. The a nozzle adjustment member for a sprinkler includes a hollow pipe 10, two adjustment pieces 20 and a nozzle cover 30.

A flat top stage 11 with a plurality of holes 14 spaced at the same interval along an axis of the hollow pipe 10 is disposed on the top of the hollow pipe 10. The holes 14 are assembled with a nozzle set 40 mounted in the hollow pipe 10. A plurality of racks 16 equal in height is respectively arranged at the outside of the hollow pipe 10, between two adjacent holes 14. The above nozzle set 40 is formed by a plurality of nozzle tubes 41 arranged in parallel with a certain interval. Moreover, the bottom surfaces of the nozzle tubes 41 are connected with one another by a belt 42 to form a bar-like structure. Each nozzle tube 41 is inserted through the corresponding hole 14 of the hollow pipe 10 correspondingly. The bottom of each of the plurality of nozzle tubes 41 is fixed and located in the corresponding hole 14 firmly while the top end of the nozzle tube 41 extends from the hole 14. The height of the top end of the nozzle tube 41 out of the hole 14 is larger than the height of the rack 16. A plurality sets of symmetrical fastening holes 17 is disposed along two long sides of the flat top stage 11 of the hollow pipe 10 so as to be fastened and assembled with the nozzle cover 30.

The adjustment piece 20 is a flat plat whose bottom is leaning against the top end of the plurality of racks 16 of the hollow pipe 10. A round pivot hole 21 is disposed on one end of the adjustment piece 20, near the edge of that end and a plurality of guiding openings 22 spaced at an interval is arranged on the adjustment piece 20 between the round pivot hole 21 and the other end of the adjustment piece 20. The pivot holes 21 and the plurality of guiding openings 22 of the two adjustment pieces 20 are positioned over the plurality of nozzle tubes 41 of the nozzle set 40 correspondingly. A projecting control part 23 is arranged on the edge of the front end as well as the rear end of the adjustment piece 20, near the outermost guiding opening 22 for convenience of holding and moving the adjustment piece 20.

Figure 8:
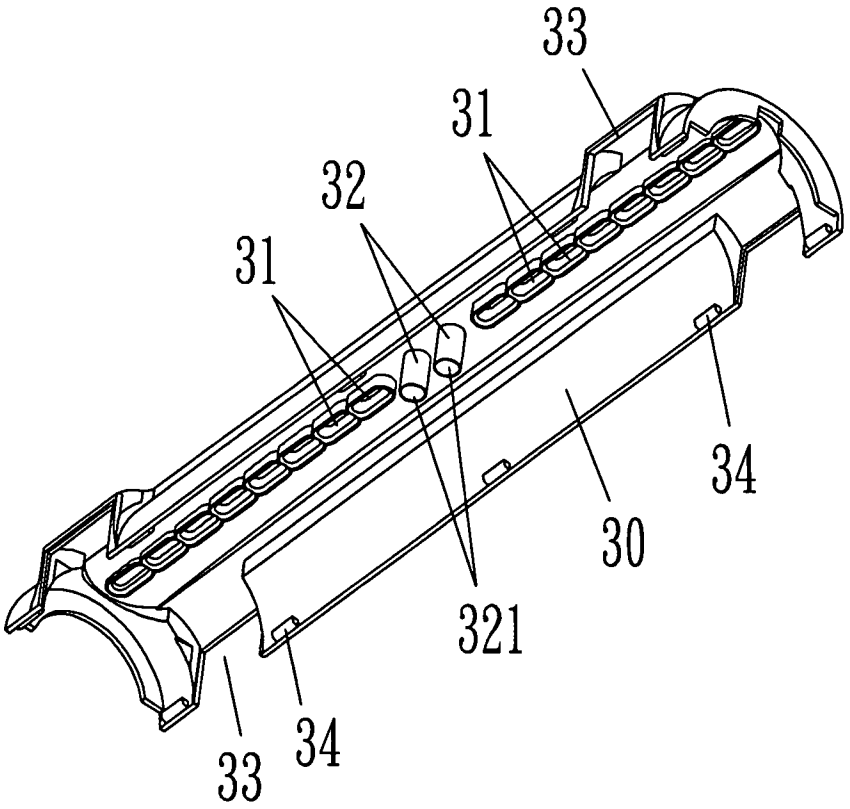
FIG. 8 is a bottom view of a nozzle cover of an embodiment according to the present invention.
Figure 9:
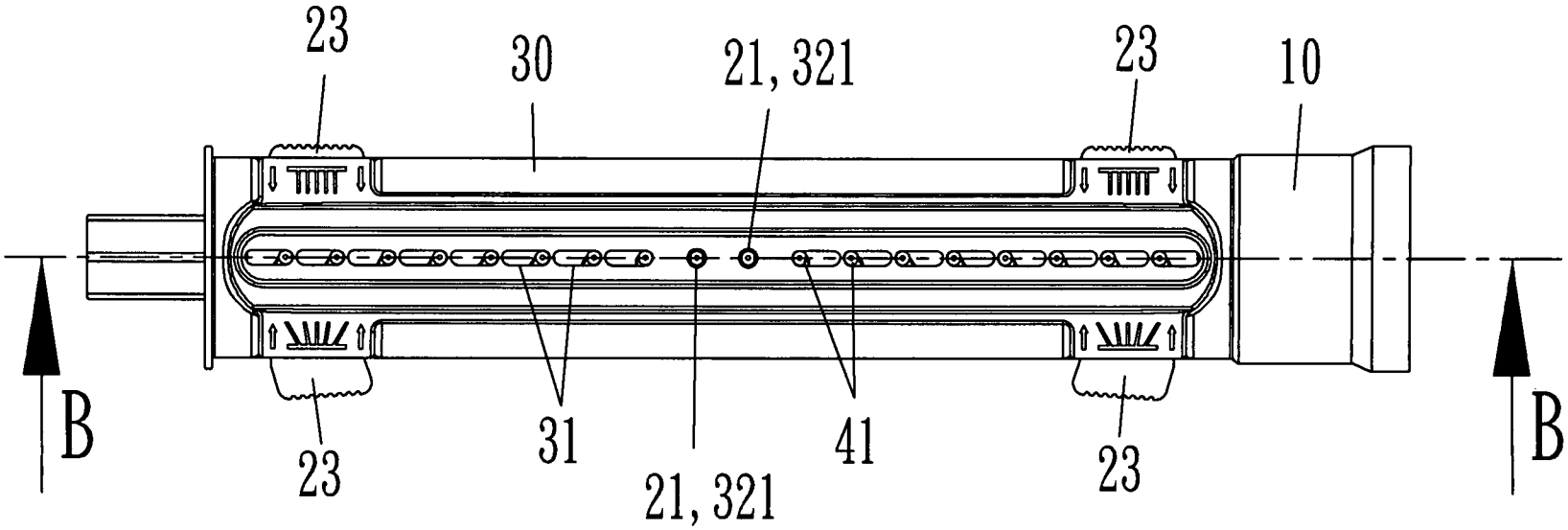
FIG. 9 is a top view of an embodiment according to the present invention.
Figure 10:
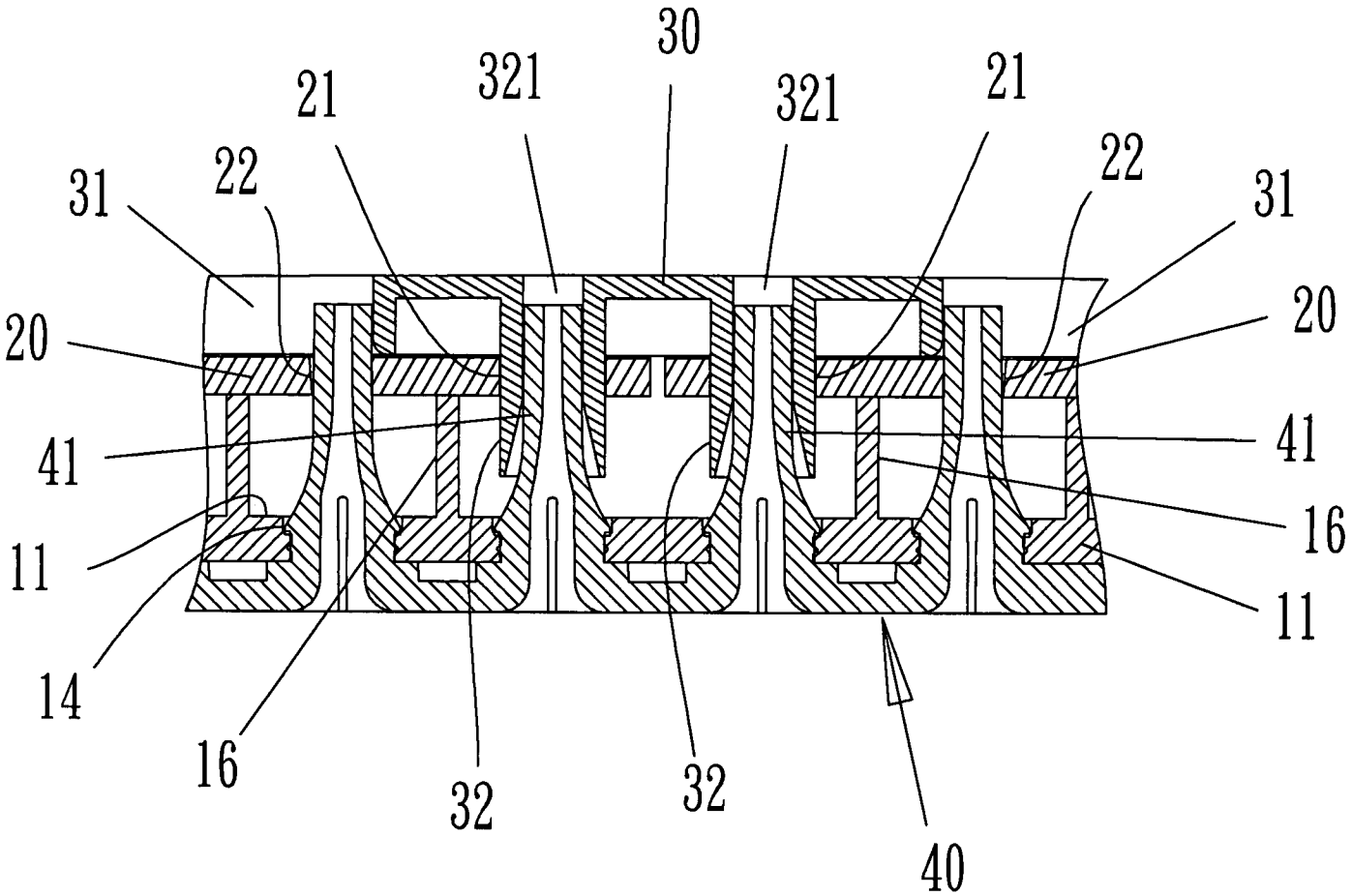
FIG. 10 is a cross sectional view along the B-B line of the embodiment in FIG. 9.
Figure 11:
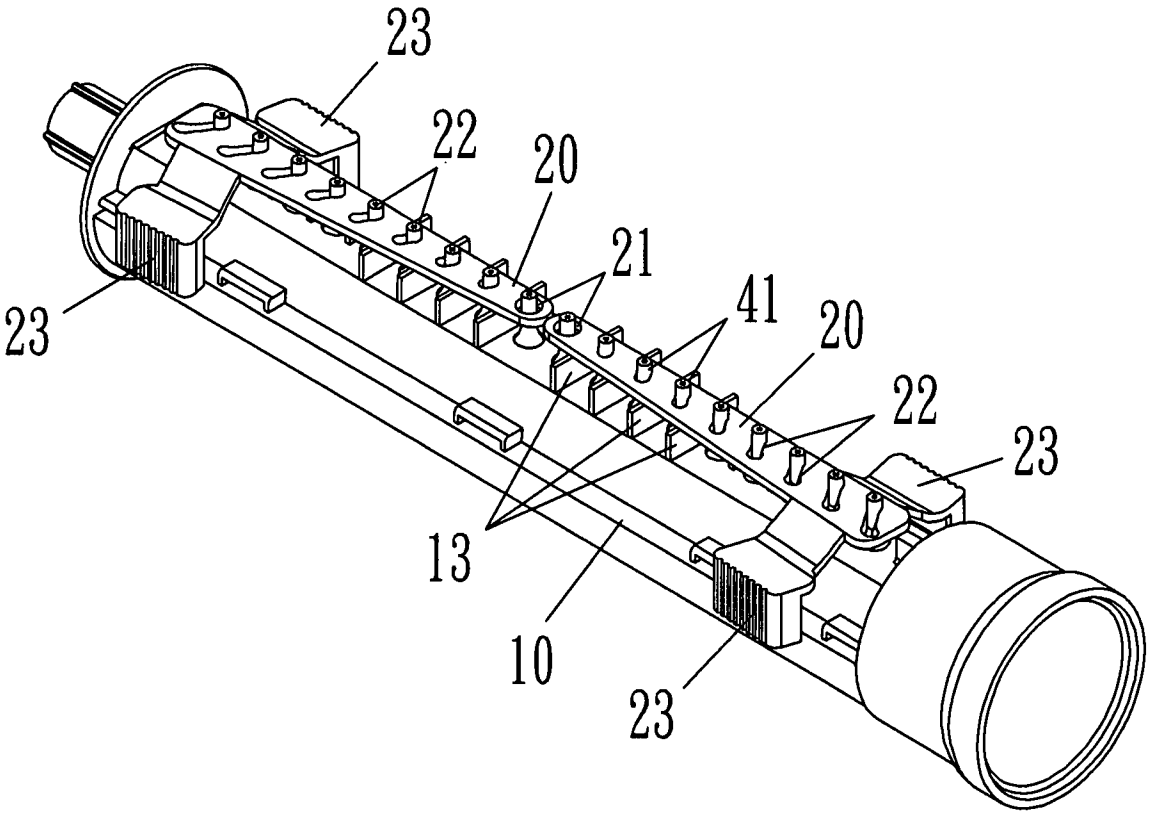
FIG. 11 is an assembly view showing the embodiment in FIG. 9 with a hidden nozzle cover according to the present invention.
Figure 12:
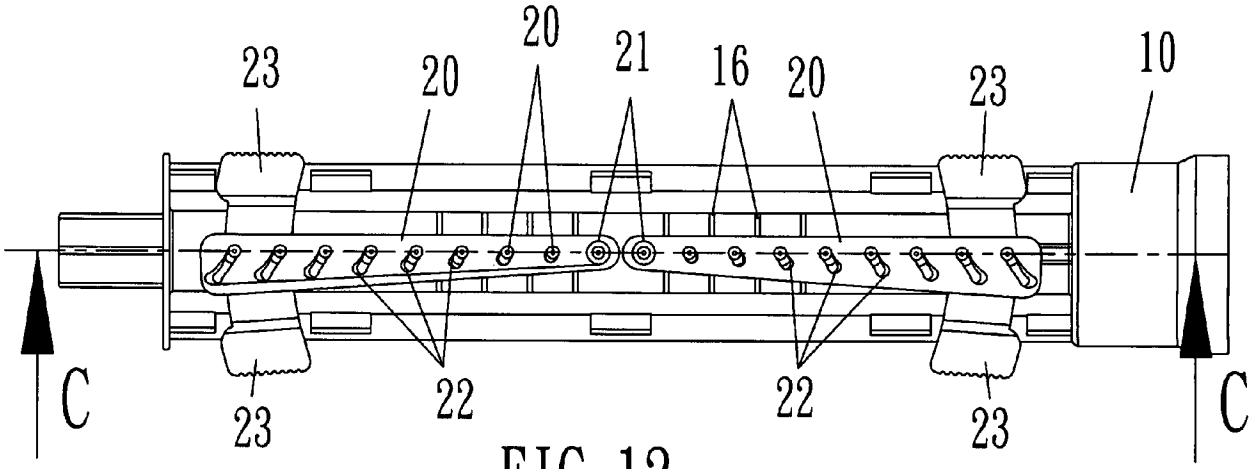
FIG. 12 is a top of the embodiment in FIG. 11.
Figure 13:
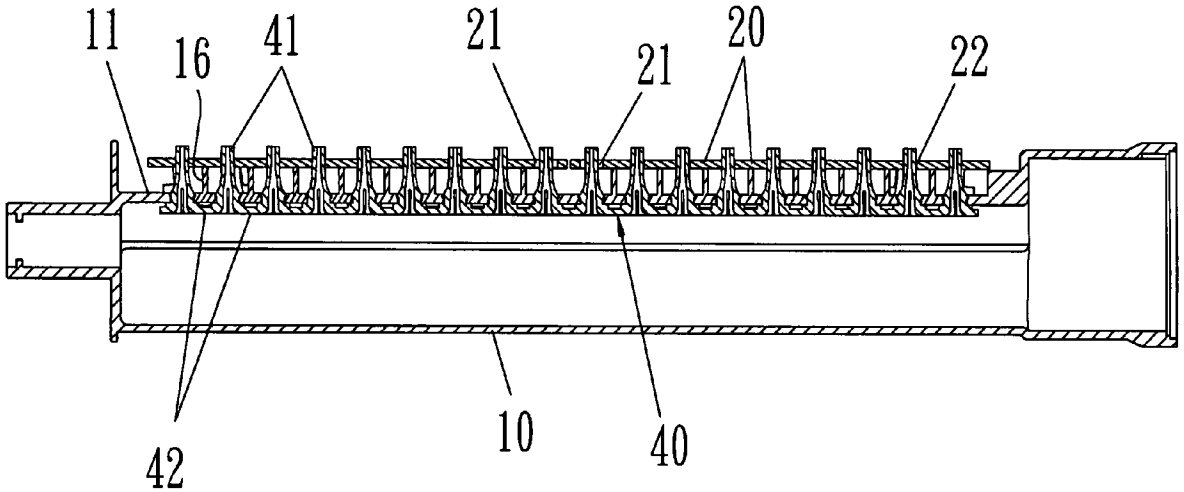
FIG. 13 is a cross sectional view along the C-C line of the embodiment in FIG. 12.
Figure 14:
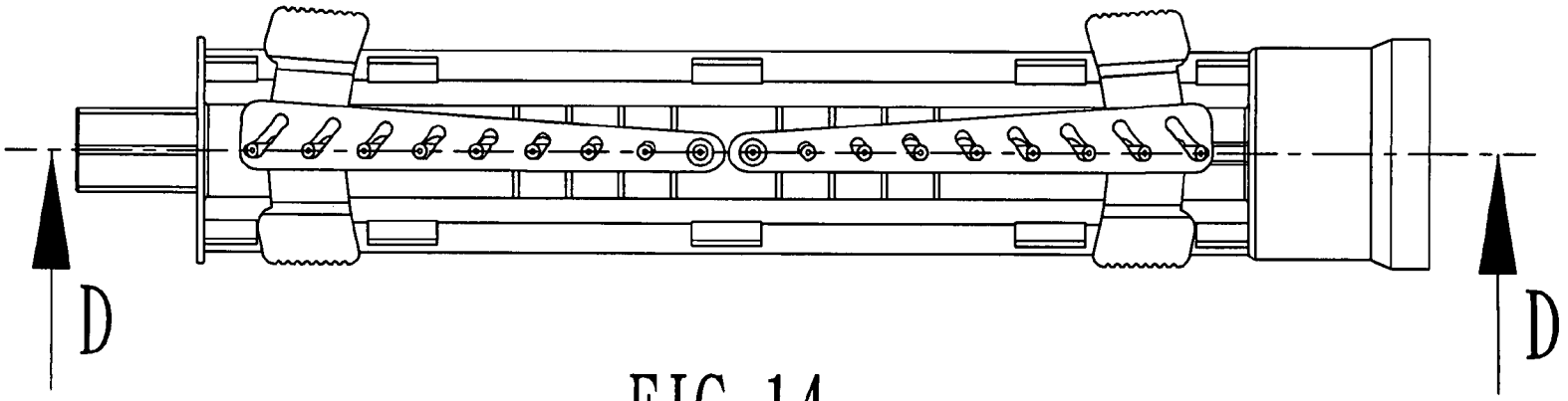
FIG. 14 is a top view of swinging adjustment pieces of an embodiment according to the present invention.
Figure 15:
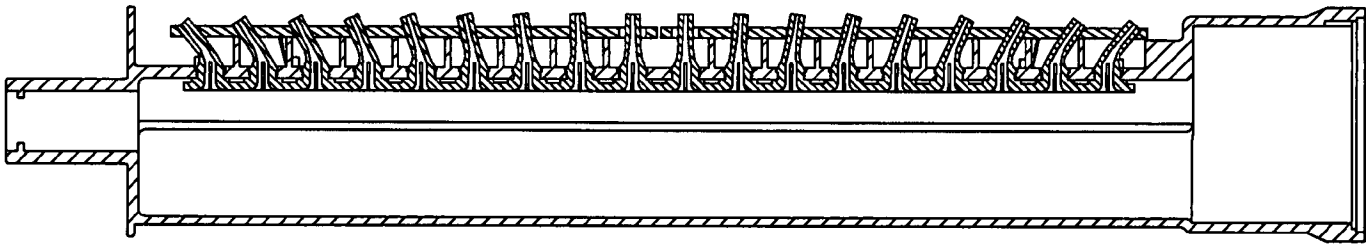
FIG. 15 is a cross sectional view along the D-D line of the embodiment in FIG. 14.

Also refer to FIG. 8, the nozzle cover 30 is a cover with a downward opening. Two shaft tubes 32 extending downward are disposed on a middle part thereof and shaft holes 321 of these two shaft tubes 32 penetrate the cover. Moreover, the nozzle cover 30 includes a plurality of long through holes 31 extending outwards from the two shaft tubes 32 to two ends of the nozzle cover 30. The two shaft holes 321 and the plurality of long through holes 31 are aligned and are positioned over the plurality of nozzle tubes 41 of the nozzle set 40 correspondingly. The two shaft tubes 32 are respectively inserted through and located by the pivot holes 21 of the two adjustment pieces 20 while the shaft holes 321 are positioned over corresponding nozzle tubes 41. Furthermore, a plurality sets of symmetrical fastening blocks 34 is disposed along an inner side of the two long sides on the bottom of the inner surface of the nozzle cover 30 so as to be assembled with the plurality sets of symmetrical fastening holes 17 of the hollow pipe 10 correspondingly. Two receiving spaces 33 with a downward opening for receiving the control part 23 of the adjustment piece 20 are arranged at two outer ends of the two long sides of the nozzle cover 30 respectively.

In accordance with the structure constructed by above components, after the two adjustment pieces 20 and the nozzle cover 30 being arranged and located over the top of the hollow pipe 10 in turn, each nozzle tube 41 of nozzle set 40 is inserted through the pivot holes 21 and the guiding hole 22 of the two adjustment pieces 20 as well as the shaft holes 321 and the long through holes 31 of the nozzle cover 30 respectively and correspondingly. The top end of each nozzle tube 41 is projecting out of or close to the top surface of each long through hole 31 with a certain distance therebetween. As to the control part 23 near the outer end of the two adjustment pieces 20, it is mounted in the receiving space 33 on the corresponding end of the nozzle cover 30.

Thereby the nozzle cover 30 and the hollow pipe 10 are integrated. While adjusting and moving the adjustment pieces 20, the nozzle cover 30 remains static. From a fixed pivot point formed by the connected pivot hole 21 and the shaft tube 32 on one end of the adjustment piece 20, the two adjustment pieces 20 respectively swing through the movement of the control parts 23 on the opposite end ends. Thus while moving the control part 23, the nozzle cover 30 is static and the nozzle tube 41 positioned in the shaft hole 321 of the shaft tube 32 is also static while other nozzle tubes 41 in the corresponding plurality of guiding opening 22 of the two adjustment pieces 20 are driven to be moved at an angle synchronously so as to generate radial water distribution patterns with different angles.

Moreover, the two adjustment pieces 20 can move to and fro in a swing independently. Thus once the nozzle set 40 is divided into two halves, approximately equal in area, or a plurality of independent parts to be driven and adjusted, more sprinkling patterns can be provided.

Figure 16:
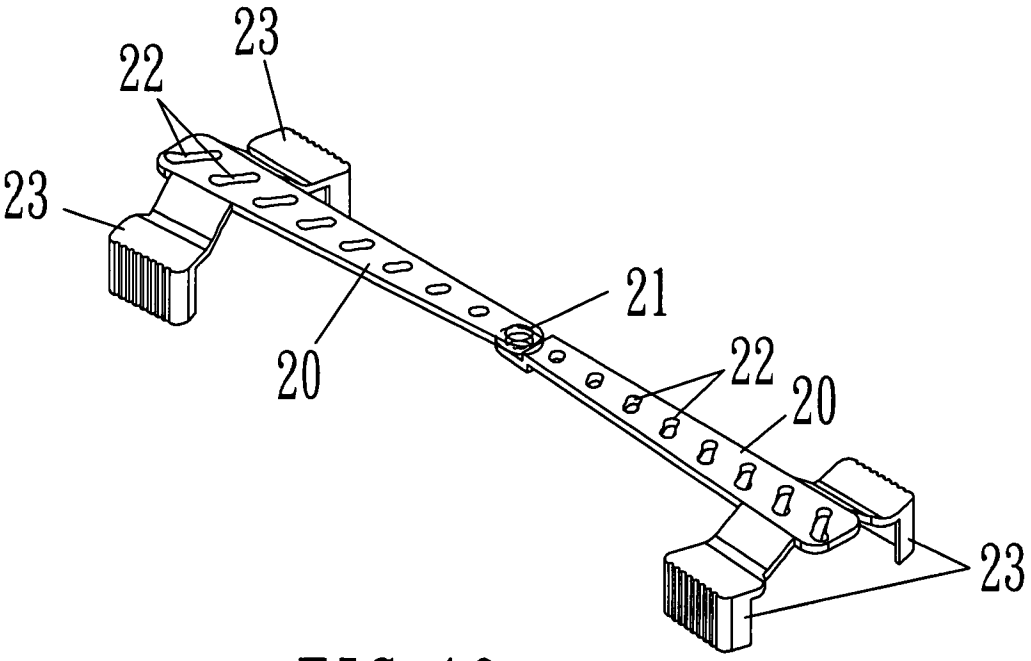
FIG. 16 is a schematic drawing showing an embodiment of an adjustment piece according to present invention.
Figure 17:
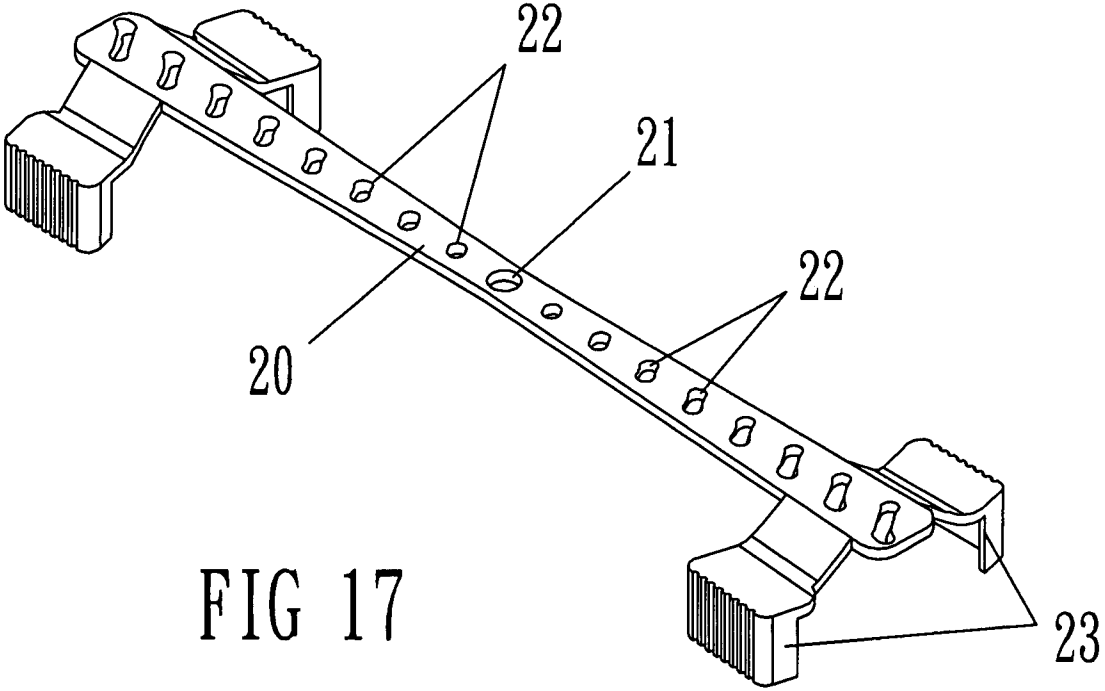
FIG. 17 is a schematic drawing showing another embodiment of an adjustment piece according to present invention.

Refer to FIG. 16, the pivot holes 21 of the two adjustment pieces 20 in the above embodiment are overlapped and integrated so as to swing around the same pivot point. Or as shown in FIG. 17, the two adjustment pieces 20 in the above embodiment are integrated into a single piece and the pivot hole 21 is arranged at the middle of the single adjustment piece 20. A plurality of guiding opening 22 spaced at an interval is arranged at the adjustment piece 20, extending from two sides of the pivot hole 21 to two ends of the adjustment piece 20.

Figure 18:
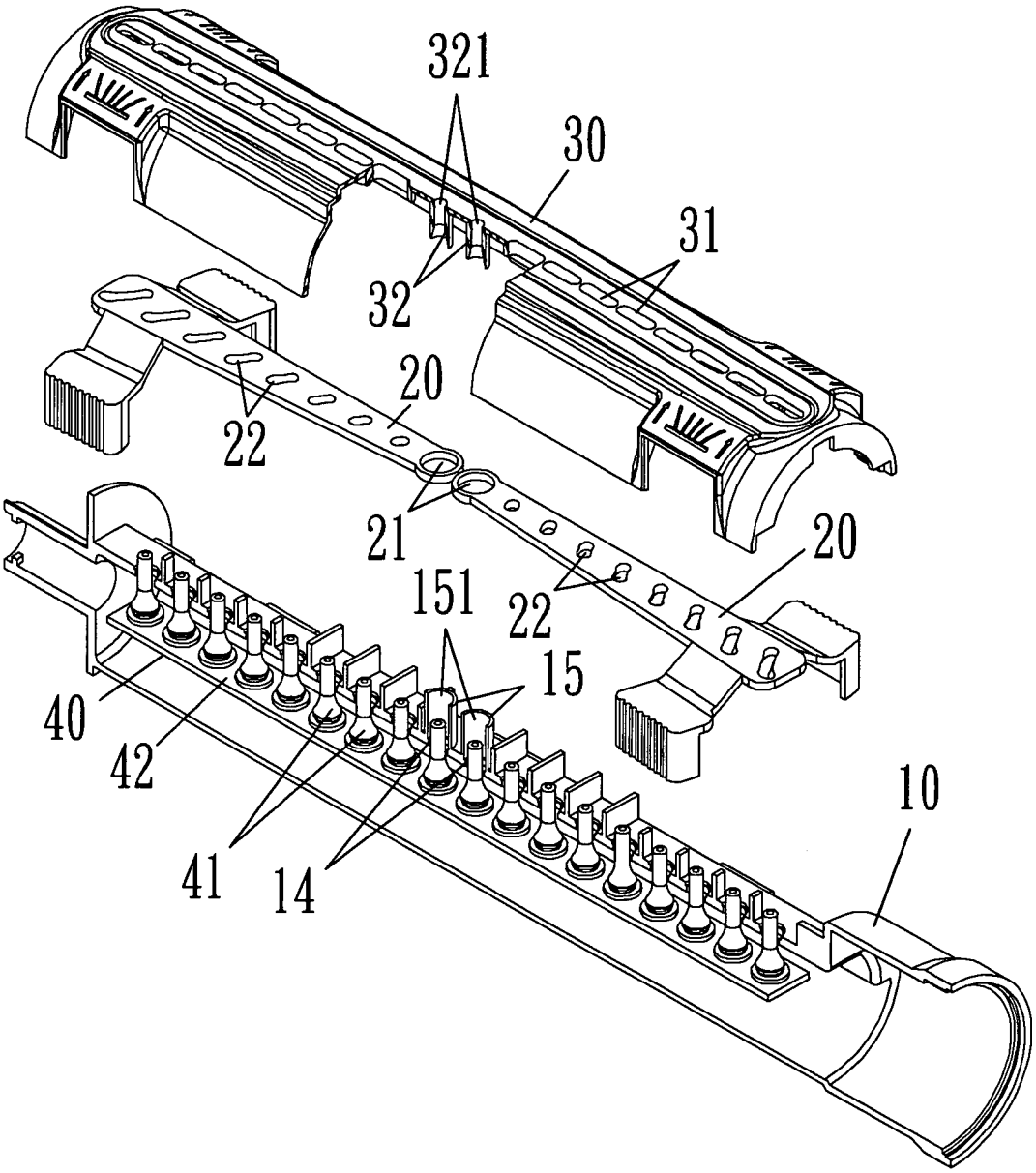
FIG. 18 is an explosive view of a further embodiment according to the present invention.
Figure 19:
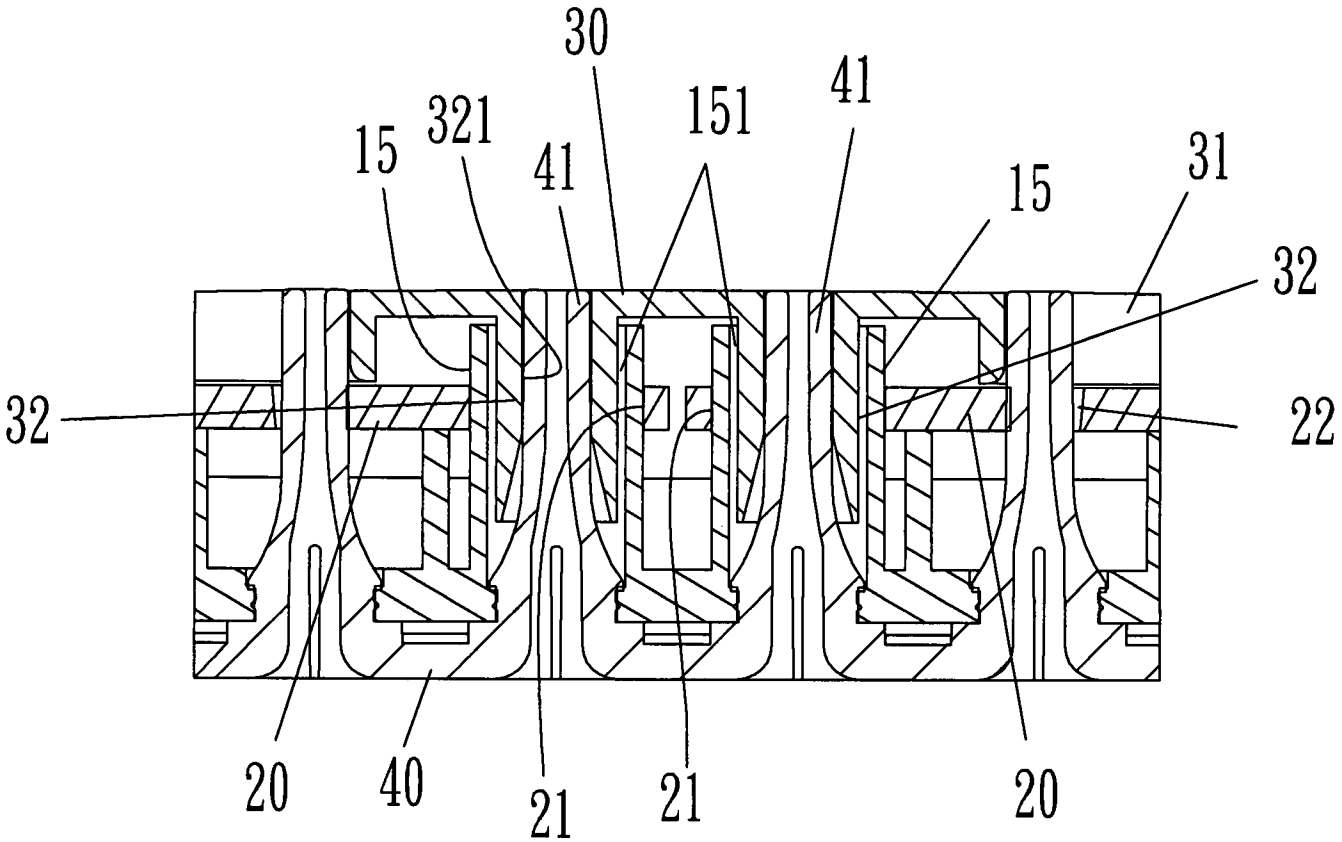
FIG. 19 is a partial front cross sectional view of the embodiment in FIG. 18.

Refer to FIG. 18 and FIG. 19, a further embodiment of the present invention is disclosed.

A flat top stage 11 with a plurality of holes 14 spaced at an interval along an axis of the hollow pipe 10 is disposed on the top of the hollow pipe 10. The holes 14 are assembled with a plurality of nozzle tubes 41 of a nozzle set 40 mounted in the hollow pipe 10. A pivot support 15 is extending around each of two holes 14 on the middle part of the hollow pipe 10. The hole 14 inside the pivot support 15 is positioned over the corresponding nozzle tubes 41 of the nozzle set 40 for location while a tube hole 151 of the pivot support 15 is for receiving and locating shaft tubes 32 of a nozzle cover 30. The two adjustment pieces 20 have similar structure to that of the above embodiments. A pivot hole 21 positioned over the pivot support 15 is arranged at one end of the adjustment piece 20 and a plurality of guiding openings 22 extending outward from the pivot hole 21 is disposed on the adjustment piece 20. The plurality of guiding openings 22 are assembled with the plurality of nozzle tubes 41 correspondingly. The nozzle cover 30 also has similar structure. Two shaft tubes 32 extending downward and mounted in the tube holes 151 of the pivot support 15 are disposed on a middle part of the nozzle cover 30. A plurality of long through holes 31 for being positioned over the corresponding nozzle tubes 41 is arranged on the nozzle cover 30, extending outward from the two shaft tubes 32.

Thereby the two nozzle tubes 41 on the middle of the nozzle set 40, the pivot holes 21 of the two adjustment pieces 20 and the shaft tubes 32 of a nozzle cover 30 are all assembled with two pivot supports 15 of the hollow pipe 10 and are fixed. Thus while the adjustment piece 20 swings, the pivot hole 21 is used as a pivot, the nozzle tubes 41 move an angle along with the movement of the adjustment piece 20 except the nozzle tubes 41 in the holes 14 inside the pivot support 15 that are fixed and stopped.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A nozzle adjustment member for a sprinkler comprising:

a hollow pipe having at least two rows of a plurality of holes disposed on a top thereof, wherein said hollow pipe comprises a top stage and a plurality of nozzle tubes, wherein two rows of said holes are formed at said top stage, wherein said hollow pipe further comprises two pivot supports upwardly protruded from two diagonal corners of said to stage, wherein each of said Pivot supports has an aligned hole aligned with one of said holes at each row, such that when said nozzle tubes upwardly pass through said holes on said top stage respectively, two of said nozzle tubes further pass through said aligned holes of said pivot supports respectively;

a nozzle cover fastened and integrated with said hollow pipe and having at least two rows of long through holes positioned over said plurality of nozzle tubes and arranged on a top thereof; and two adjustment pieces each having a pivot hole formed at one end, a control part formed an opposed end, and a plurality of guiding openings spacedly formed between said Pivot hole and said control part, wherein said pivot supports are coupled at said pivot holes of said adjustment pieces respectively, wherein said nozzle tubes further upwardly pass through said guiding openings of said adjustment pieces respectively, wherein said two nozzle tubes further pass through said Pivot holes of said adjustment pieces from said aligned holes of said pivot supports respectively;

wherein when each of said adjustment pieces is independently and pivotally swung around said pivot hole as a static pivot via said control part, said plurality of nozzle tubes at each row are driven to synchronously move and tilt at different angles both in transverse and longitudinal directions so as to provide various sprinkling patterns.

2. The nozzle adjustment member, as recited in claim 1, wherein said guiding openings are spaced at an interval on each of said adjustment pieces that nozzle tubes at each row are driven to synchronously move and tilt at different angles by lengths of said guiding openings.

3. The nozzle adjustment member, as recited in claim 1, wherein said two adjustment pieces are pivotally coupled on said top stage and are arranged alongside in opposite directions in such a manner that said two control parts are respectively arranged at two opposite sides of said two adjustment pieces to pivotally move said adjustment pieces independently.

4. The nozzle adjustment member, as recited in claim 2, further comprising a seat, at least one water inlet arranged at least one side of said seat for connecting with a water source, a pivot connecting said hollow pipe with said seat to enable said hollow pipe to rotate at reversibly rotational manner, a fine adjustment knob operatively coupled with said pivot for controlling outlet water flow extending outward from said pivot, and a control button operatively coupled at said hollow pipe for angle adjustment of forward and backward movement of said hollow pipe via said pivot.

5. The nozzle adjustment member, as recited in claim 1, wherein each of said adjustment pieces further comprises a Pivot bushing formed at said end of said adjustment piece to form said pivot hole within said pivot bushing, wherein said pivot bushing is pivoted at said pivot support, wherein at least one pin is arranged at a bottom of said adjustment piece, wherein said pivot bushing and said pin have the same height to lean against said top stage.

6. The nozzle adjustment member, as recited in claim 4, wherein each of said adjustment pieces further comprises a Pivot bushing formed at said end of said adjustment piece to form said pivot hole within said pivot bushing, wherein said pivot bushing is pivoted at said pivot support, wherein at least one pin is arranged at a bottom of said adjustment piece, wherein said Divot bushing and said pin have the same height to lean against said too stage.

7. The nozzle adjustment member, as recited in claim 1, wherein said pivot support is arranged at each diagonal corner of said two rows of said plurality of holes, around said farthest hole.

8. The nozzle adjustment member, as recited in claim 6, wherein said pivot support is arranged at each diagonal corner of said two rows of said plurality of holes, around said farthest hole.

9. The nozzle adjustment member, as recited in claim 1, wherein said pivot support is arranged at an outer end of the farthest hole.

10. The nozzle adjustment member, as recited in claim 1, wherein bottoms of said plurality of nozzle tubes are connected into one piece or connected into two independent nozzle sets.

11. The nozzle adjustment member, as recited in claim 6, wherein bottoms of said plurality of nozzle tubes are connected into one piece or connected into two independent nozzle sets.

12. The nozzle adjustment member, as recited in claim 1, wherein at least two receiving spaces for receiving said control part are arranged at said nozzle cover.

13. The nozzle adjustment member, as recited in claim 4, wherein two receiving spaces for receiving said two control part are arranged at two opposite sides of said nozzle cover.

14. The nozzle adjustment member, as recited in claim 1, wherein each of said adjustment pieces is integrated with each of said control parts.

15. The nozzle adjustment member, as recited in claim 4, wherein each of said adjustment pieces is integrated with each of said control parts.

16. The nozzle adjustment member, as recited in claim 1, wherein each row of said long through holes of said nozzle cover is integrated into an integral slot.

17. The nozzle adjustment member, as recited in claim 1, wherein some of said long through holes are longer than other said long through holes.

18. The nozzle adjustment member, as recited in claim 1, wherein said pivot support is mounted with or without said nozzle tube therein optionally.

19. The nozzle adjustment member, as recited in claim 1, further comprising at least one belt connecting bottoms of said plurality of nozzle tubes.

20. The nozzle adjustment member, as recited in claim 1, further comprising at least one shaft tube extending downward arranged at an edge of an inner side of each row of said long through holes so as to mount into said pivot hole of said adjustment piece.

21. A nozzle adjustment member for a sprinkler, comprising:

a hollow pipe having at least one row of a plurality of holes is disposed on a top thereof, wherein said hollow pipe comprises a top stage and a plurality of nozzle tubes upwardly passing through said holes respectively wherein row of said holes are formed at said top stage, wherein said hollow pipe further comprises at least one pivot support upwardly protruded from said top stage, wherein said pivot support has an aligned hole aligned with one of said holes, such that when said nozzle tubes upwardly pass through said holes on said top stage respectively, one of said nozzle tubes further passes through said aligned hole of said pivot support;

a nozzle cover fastened and integrated with said hollow pipe and having at least one rows of long through holes positioned over said plurality of nozzle tubes and arranged on a top thereof; and at least one adjustment piece having a pivot hole formed at one end, a control part formed an opposed end, and a plurality of guiding openings spacedly formed between said pivot hole and said control part, wherein said pivot support passes through said pivot hole of said adjustment piece, wherein said nozzle tubes further upwardly pass through said guiding openings of said adjustment pieces respectively, wherein one of said nozzle tubes further passes through said pivot hole of said adjustment piece from said aligned hole of said pivot support;

wherein when said adjustment piece is pivotally swung said pivot hole as a static pivot via said control part, at least one row of said plurality of nozzle tubes are driven to synchronously move and tilt at different angles both in transverse and longitudinal directions so as to provide various sprinkling patterns.

22. The nozzle adjustment member, as recited in claim 21, further comprising a seat, at least one water inlet arranged at least one side of said seat for connecting with a water source, a pivot connecting said hollow pipe with said seat to enable said hollow pipe to rotate at reversibly rotational manner, a fine adjustment knob operatively coupled with said pivot for controlling outlet water flow extending outward from said pivot, and a control button operatively coupled at said hollow pipe for angle adjustment of forward and backward movement of said hollow pipe via said pivot, wherein said pivot supports are provided on an inner surface of said nozzle cover.

* * * * *